US010726675B2

(12) United States Patent
Moret, Jr.

(10) Patent No.: US 10,726,675 B2
(45) Date of Patent: Jul. 28, 2020

(54) STRUCTURES ADDING FAIRNESS AMONG PLAYERS IN DOMINO WAGERING EVENT

(71) Applicant: Harold Moret, Jr., Los Angeles, CA (US)

(72) Inventor: Harold Moret, Jr., Los Angeles, CA (US)

( * ) Notice: Subject to any disclaimer, the term of this patent is extended or adjusted under 35 U.S.C. 154(b) by 0 days.

(21) Appl. No.: 16/219,550

(22) Filed: Dec. 13, 2018

(65) Prior Publication Data

US 2020/0193777 A1 Jun. 18, 2020

(51) Int. Cl.
*A63F 9/20* (2006.01)
*G07F 17/32* (2006.01)
*G06Q 50/34* (2012.01)

(52) U.S. Cl.
CPC ..... *G07F 17/3267* (2013.01); *A63F 9/20* (2013.01); *G06Q 50/34* (2013.01); *G07F 17/3244* (2013.01); *G07F 17/3276* (2013.01)

(58) Field of Classification Search
CPC ..... A63F 9/20; G07F 17/32
See application file for complete search history.

(56) References Cited

U.S. PATENT DOCUMENTS

2008/0018049 A1* 1/2008 Hebden ..... G07F 17/3276 273/292
2009/0124379 A1* 5/2009 Wells ..... G07F 17/3211 463/31

* cited by examiner

*Primary Examiner* — Omkar A Deodhar
(74) *Attorney, Agent, or Firm* — Mark A. Litman & Associates, P.A.

(57) ABSTRACT

A system and method for playing a competitive wagering domino event using a physical or virtual play surface having positions for from 2-4 players, 28 standard domino tiles and a play rotation sign that is reversible to indicate direction of play in player order for each game executed on the play surface.

20 Claims, 4 Drawing Sheets

↑
102

↑
100

↑
102

↑
100

STRUCTURES ADDING FAIRNESS AMONG PLAYERS IN DOMINO WAGERING EVENT

BACKGROUND OF THE INVENTION

1. Field of the Invention

The present invention relates to the field of domino game play and in particular modified domino systems and apparatus that enable equitable wagering games in player-versus-player competitions.

2. Background of the Art

Dominoes is a well-established game, with certain areas of the U.S. and the world deeming it a game of great fun and entertainment. Domino players often compete in residences and bars and local clubs for fun or cash. It has not been easy to develop casino or card room type domino games that are fair to players and provide a revenue stream to the facility providing domino games.

The basic rules of domino play are firmly established, even though there are variants of the game (e.g., Mexican Train domino, Chickenfoot domino, etc.). These rules can be summarized as:

Shuffling the Dominoes

Before a game or hand begins, the dominoes must be shuffled, so that no one knows the location of any given tile. Typically, the tiles are shuffled by turning them all face-down on the table, then moving them around in a random motion, being careful not to flip over any of the pieces. The collection of shuffled tiles is called the boneyard.

Beginning a Game

Before a game begins, the players have to determine who has the first move. This happens in one of two ways: either each of the players choose a domino at random, with first move going to the player holding the "heavier" domino (these dominoes are returned to the boneyard and reshuffled), or the players draw their allotted number of tiles (which varies according to the game being played), and the holder of the "heaviest" domino goes first.

Drawing Tiles

Once the players begin drawing tiles, they are typically placed on-edge before the players, so that each player can see his own tiles, but none can see the value of other players tiles. Every player can thus see how many tiles remain in the other players hands at all times during gameplay.

Placing the First Tile

Once all the players have drawn their dominoes, the first player (determined either by the drawing of lots, or by who holds the heaviest hand) places the first tile on the table. Typically, this is the double-six. If no one holds the double-six, then the double-five is played, and so on. As shown in FIG. 3.

Playing Subsequent Tiles

In most domino games, only the "open" ends of a layout are open for play. An end is open when it has no other tile connected to it. Often, a double is placed cross-ways in the layout, straddling the end of the tile that it is connected to. Usually, additional tiles can only be placed against the long side of a double. However, the rules of some games consider all four sides of a double to be open, allowing dominoes to be connected in all four directions.

For example, in the diagram on the right, the first tile played was the 6-6. At this point, a domino can either be played to the right or left of the 6-6. The second tile placed was a 6-5, to the right of the 6-6. At this point, the open ends are 5 and 6. The third tile played was a 4-6, to the left of the initial tile, producing open ends of 4 and 5. The fourth tile was the 5-5, placed vertically. Again, the open ends are 4 and 5.

At any time, due to space constraints or mere whim, a tile may be connected at a right-angle, creating an "L" in the layout.

Drawing Tiles

As the turn passes from player to player, if someone cannot make a move, they're going to do one of two things, based on the game being played. In "block" games (or if there are no tiles left in the boneyard), a player must "pass" if he cannot make a move. In a "draw" game, a player can draw a tile from the boneyard. Depending on the game, he can then either play it (if it fits, and if the rules allow), pass (if he cannot play the drawn tile), or continue drawing until he can make a move or the boneyard is empty.

Currently, most rules allow the boneyard to be emptied completely. However, some rules do not allow the last tow tiles in the boneyard to be removed, and at the end of a game, the winner receives the value of the tiles in the boneyard.

Ending A Game

A game ends either when a player plays all his tiles, or when a game is blocked. When a player plays his last time, tradition requires him to say "domino" (when this happens, the other players are said to have been dominoed. A game is blocked when no player is able to add another tile to the layout.

When playing a multi-round game, domino games are typically scored by awarding the number of pips on opposing player's tiles to the winner. Doubles may be counted as one or two (if one, a 6-6counts as 6; if two, a 6-6 counts as 12), and double-blank may either count as 0 or 14. (These rule variations must be agreed upon before the game begins!) The player who reaches the target score (100, 200, or whatever is agreed on among the players), or the player who amasses the most points is a given number of rounds wins the game.

One problem with attempting to make casinos and card rooms amenable to domino play is assure as equitable play amongst players and positions at a gaming event.

SUMMARY OF THE INVENTION

A system for playing a competitive wagering domino event comprising a play surface having positions for from 2-8 players, 28 standard domino tiles and a play rotation sign that is reversible to indicate direction of play in player order for each game executed on the play surface. At the end of any domino game, the indicated direction on the play rotation sign is reversed.

DETAILED DESCRIPTION OF THE INVENTION

Figure 1:
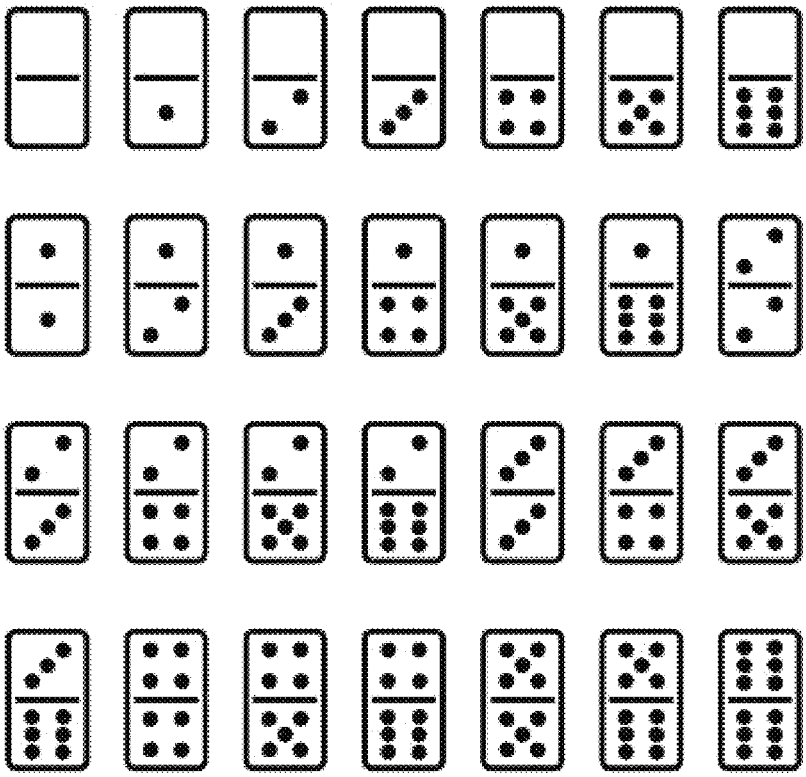
FIG. 1 shows a complete standard domino tile set on a felt play surface.

The underlying gaming equipment in the practice of the present technology and the invention includes what is variously referenced in the art of dominoes as "Big 6 Dominoes" or standard dominoes. These tiles or playing cards or images (referred to as tiles) always consist of 28 distinct and different tiles, as shown in FIG. 1. An essential additional apparatus in this technology is display play rotation signage. This is an essential feature to assuring and implementing fairness in repeated player-versus-player competitive domino wagering games.

There is a slight advantage in the ordering of play in the execution of a game, because even if all players consecutively place a tile without having to scavenge in the boneyard, the first player would win. In a friendly game, the advantage would be insignificant, but in a wagering event, any advantage at a particular position would be unfair to players and reduce desirability of play.

The present technology includes both unique apparatus and use of that apparatus in a method to address this heretofore unexamined issue of fairness in competitive wagering domino play. A system for playing a competitive wagering domino event may include a play surface (as on a gaming table top, electronic or physical gaming table top, and the like) having positions for from 2-8 players, preferably from 2-4 players and even just 2 or 3 players, 28 standard domino tiles and a play rotation sign that is reversible to indicate direction of play in player order for each game executed on the play surface. The play surface comprises a game play felt-texture surface (e.g., either actual felt, polymer film coated with fiber or fabric, or elastomer having a surface covered with fiber or fabric) and the play rotation sign is a physical element with a single directional arrow on a face of the physical element that lays on the play surface. It may be any visual display (e.g., LED bulbs, LED screen plasma screen or any lightable element with at least arrow image capability in a horizontal direction).

The play surface may be a game play (e.g., solid, such as the above-described felt-texture) surface and the sign is an electronic display element visible to all player positions at the play surface, the electronic display element with a single directional arrow on a face of the electronic display element that points in a single direction of play progression for a single round of the competitive wagering domino game. May have the play rotation sign on a post adjacent to or on the game play felt-texture surface. To indicate each round of play of the competitive wagering domino games, each round may be identified by sequences of odd and even numbers indicating which direction the directional arrow is to point.

The system may have the physical element with arrows on both sides of the physical element, and at least one different symbol on each side indicating which way the arrow is to face. The physical element may be a tile, a plaque, a spinner secured to the table, or any other turnable, reversable, switchable element. The system may have a button to be used by a single player (e.g., the first player or a single permanently designated player) position or a dealer position during a round of play of the competitive wagering domino game to change the direction of play after the completion of the round of play.

The system may have the electronic display element indicate individual ones of player positions on the game play felt-texture surface where a first player is located and a single direction of movement indicated by the directional arrow. The system may be configured so that after completion of a round of play of the competitive domino wagering game, the indication of the individual one of the player position moves in a direction to a different player position and the directional arrow reverses its direction.

A method for executing a competitive domino wagering event according to the present technology or invention may includes players identifying a specific value for each pip on a tile, a first domino is placed on a game table surface, an identified first player at the game table places a tile from a hand of tiles from the first player to form a first tile game play set;

the method being executed on a system for playing a competitive wagering domino event comprising a game table play surface having positions for from 2-8 players, 28 standard domino tiles and a play rotation sign that is reversible to indicate direction of play in player order for each game executed on the play surface;

a player adjacent the first player along the indicated direction of the play rotation sign then places a tile on the first tile game play set to create a second tile game play set;

all players at the play surface consecutively along the indicated direction of the play rotation sign playing one tile at a time into progressive tile game play sets until a player has exhausted all tiles in that player's hand of tiles, ending a round of play; and after the ended round of play, the play rotation sign is changed to reverse the direction of play.

The method may be executed wherein the game table play surface may be a game play felt-texture surface and the play rotation sign is a physical element with a single directional arrow on a face of the physical element that lays on the play surface and the rotation sign is manually reversed after the ended round of play.

The method may be executed wherein the game table play surface may be a game play felt-texture surface and the sign is an electronic display element visible to all player positions at the play surface, the electronic display element with a single directional arrow on a face of the electronic display element that points in a single direction of play progression for a single round of the competitive wagering domino game, and after the ended round of play, the directional arrow on the electronic display element reverses.

In the method, play rotation sign may be on a post adjacent to or on the game play felt-texture surface or any other type of play surface. Each round of play of the competitive wagering domino games may be identified by sequences of odd and even numbers indicating which direction the directional arrow is to point. The physical element preferably has arrows or other directional symbols on both sides of the physical element, and at least one different symbol on each side indicating which way the arrow is to face. In the method, where there is a button to be used by a single player position or a dealer position during a round of play of the competitive wagering domino game to change the direction of play after the completion of the round of play, the single player or dealer activates the button, or if there is a mechanical tile (or card) shuffler, completion of the shuffling may trigger a change on the signage.

In the method, where the electronic display element indicates individual ones of player positions on the game play felt-texture surface where a first player is located and a single direction of movement indicated by the directional arrow, and the directional arrow on the electronic display element reverses after the completion of the round of play. In the method, where after completion of a round of play of the competitive domino wagering game, the indication of the individual one of the player position moves in a direction to a different player position and the directional arrow reverses its direction after the completion of the round of play.

The method can be executed where there are multiple players at the game table play surface wherein:

each player provides value in the form of a buy-in amount;

each player receives five random tiles from a source of 28 standard domino tiles to form individual player tile hands;

all remaining tiles are kept in a boneyard of residual tiles;

a) the first player places a tile from a respective individual player tile hand by placing a matching side of a tile to the first tile game play set to create a second tile game play set, or if no tile from the first player respective hand is able to accomplish the match, the first player retrieves tiles from the boneyard and pays a fee to a manager of the competitive domino game until a matching tile is retrieved and placed on the first tile game play set to create a second tile game play set;

b) after the first player has placed a matching tile, a next, second player in sequence according to the direction arrow places a tile from a respective individual second player tile hand by placing a matching side of a tile to the second tile game play set to create a third tile game play set, or if no tile from the second player respective hand is able to accomplish the match, the second player retrieves tiles from the boneyard and pays a fee to a manager of the competitive domino game until a matching tile is retrieved and placed on the first tile game play set to create a third tile game play set; and c) when any placed tile scores points for a scoring player, at least a preceding player pays the scoring player value based on the points scored;

d) steps for all players proceed in accordance with a), b) and c) for all players until i) one player has exhausted all tiles in that one player's respective hand, or ii) no player can place tiles, or iii) the boneyard is exhausted; and the one player that has exhausted all tiles in the one player's hand is paid by all other players according to total numbers of pips in all other players' respective tile hands, or in events ii) or iii), all players count pips in respective players' hands, and a winning player is determined by a lowest total in a single player's tile hand, and all other players pay that single player an amount in value based on a difference between pip totals in each remaining player's hand and the pip total in the single player's hand.

A more abbreviated review of the standard set of domino rules would be:

Number of Players: 2-4

Type of Dominoes Used: Double 6

Type of Game: Scoring Game

One of the most popular of all domino games. Educational and easy to learn for children. Straight Dominoes is the game usually played at old-fashioned domino halls in small towns throughout Texas and other southern states.

Players: Two, three or four may play the game of Dominoes. If four are playing the game, it may be played as a partnership (the two players sitting opposite one another are partners).

The Shuffle: To begin the dominoes are placed face down and "shuffled." Players draw one domino. The player drawing the highest double or no double, the highest domino plays first. Re-shuffle and then begin drawing the first hand.

Drawing: Each player then draws seven dominoes for his hand. The remaining dominoes (the boneyard), if any, are left face down on the table to be drawn later it a player is unable to play from his hand.

Begin Play: The player who drew the highest double or the highest domino plays first, playing any domino he wishes from his hand.

Object of the game: Scoring points by laying the dominoes end to end (the touching ends must match: i.e., one's touch one's, two's touch two's, etc). If the dots on the exposed ends total any multiple of five the player is awarded that number of points. All sides of the first double (the spinner) may be used one piece to each side and later one to each end. All other doubles are played at right angles to the line and the total points on both ends are counted. Dominoing occurs when one player goes out by playing all of his dominoes. The sum of the spots of all opposing players is computed and added to the dominoing player's score (rounded to the nearest five). In partnership play the spots of the partner of the one who "DOMINOED" are not counted.

Blocking the Game: If in the course of the game it is impossible for any of the players to play, the game is "Blocked:" The player (or partner) having the least spots in his (or their combined) hand(s) scores the total of the spots in the opponents' hands (rounded to the nearest five). The score of 250 points is usually considered a game. The first person (or partnership) to score this amount wins the game, Shuffle and begin a new game. The player who won ordinarily plays first. This last rule is one of the reasons why in a casino or card club environment.

A review of the Figures may further assist in an appreciation of the present technology and inventor.

FIG. 1 shows a complete standard domino tile set 100 on a felt-type play surface 102.

Figure 2A:
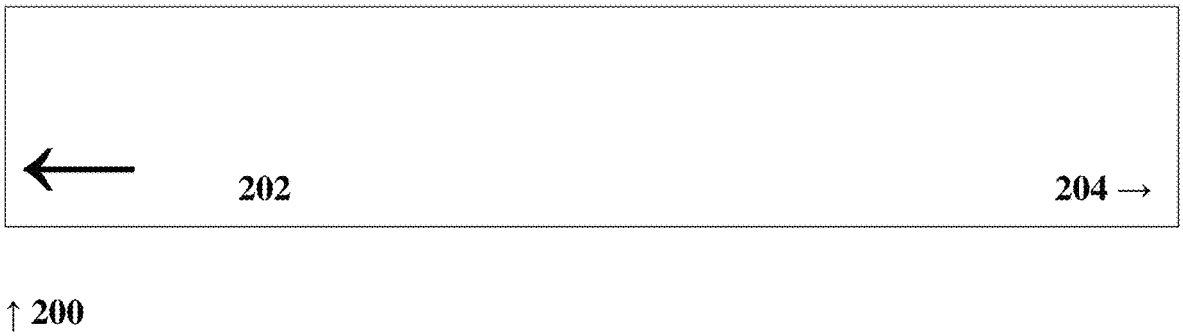
FIG. 2A shows a reversing electronic display play rotation signage.

FIG. 2A shows a reversing electronic display play rotation signage 200 having a large left pointing arrow 202 and a smaller right-pointing arrow 204. The larger font image 202 would dictate the operating direction of play. In practice, the change could just be in relative font size.

Figure 2B:
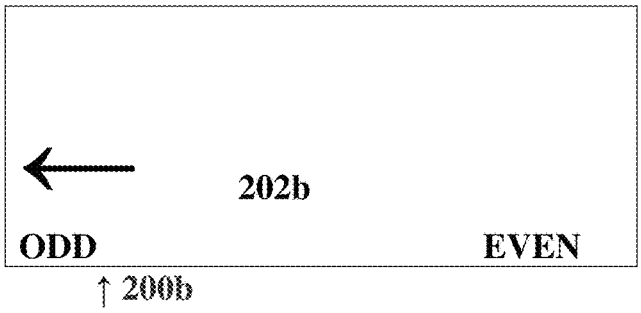
FIG. 2B shows a physical token or signage placed on a live gaming table surface to display play rotation when games end.

FIG. 2B shows a physical token or signage 200*b* placed on a live gaming table surface (not shown) to display play rotation 202*b* when games end.

Figure 2C:
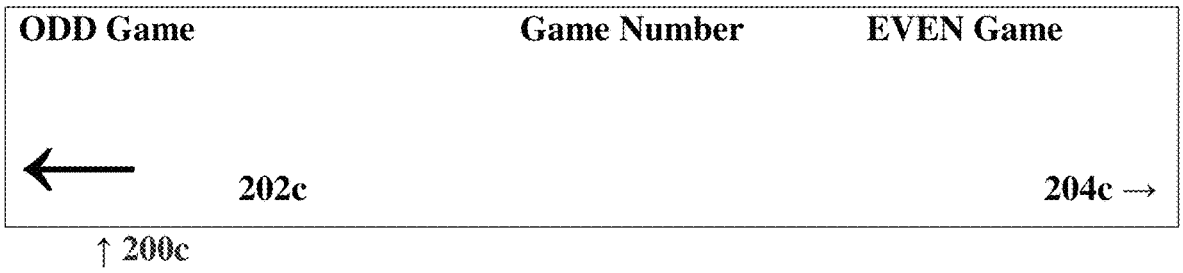
FIG. 2C shows an electronic display embedded in or positioned on a play surface to show a reversing electronic display play rotation signage.

FIG. 2C shows an electronic display 200*c* embedded in or positioned on a play surface to show a reversing electronic display play rotation signage 202*c* or 204*c*. An indication of the game number, possibly showing odd or even number of games played can he used to confirm or direct direction of play.

Figure 2D:
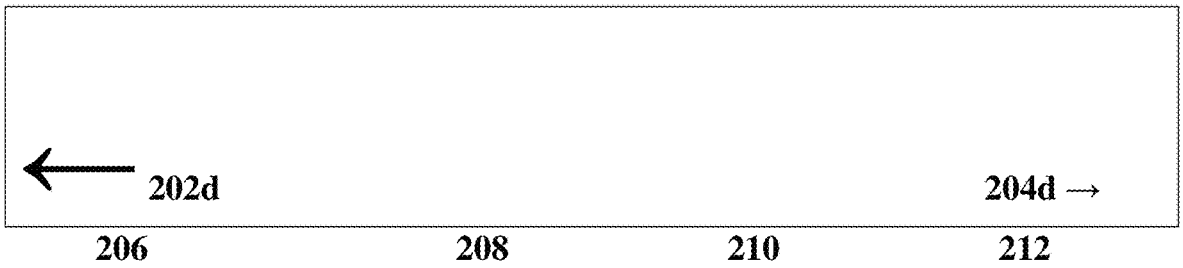
FIG. 2D shows a multiplayer start and directional signage for domino gaming.

FIG. 2D shows a multiplayer 206, 208, 210 and 212 start and directional signage for domino gaming to show a reversing electronic display play rotation signage 202*d* or 204*d*.

Figure 2E:
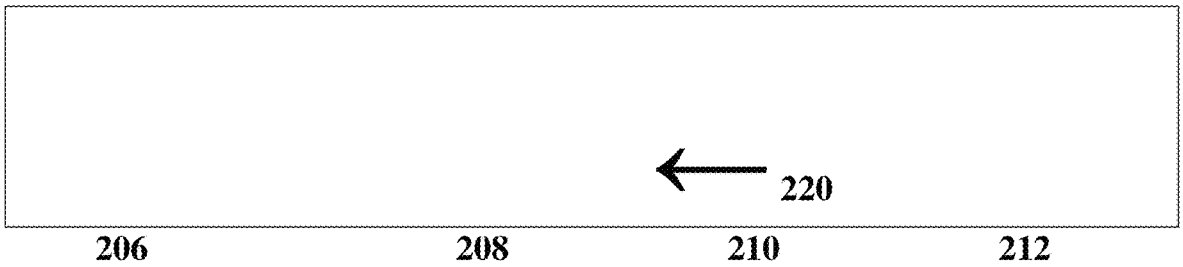
FIG. 2E shows a first position on a gaming surface with a physical token.

FIG. 2E shows a first position on a gaming surface with a physical token 220 positioned over player position 208 with the direction pointing left.

Figure 2F:
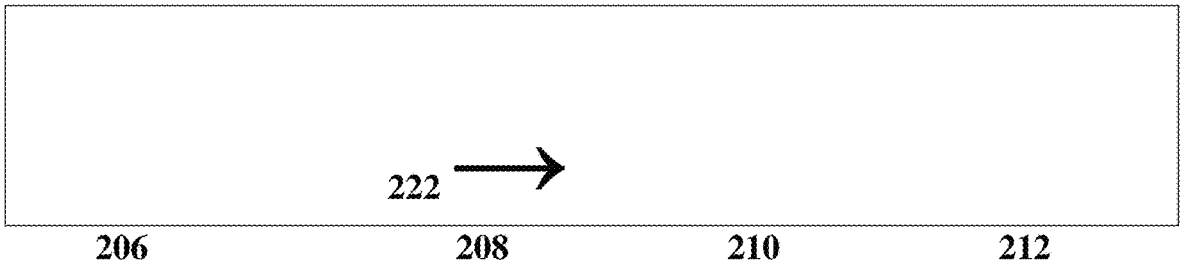
FIG. 2F shows a second position on a gaming surface with a physical taken.

FIG. 2F shows a second position on a gaming surface with a physical token 222 positioned over player position 210 with the direction pointing right.

Figure 3:
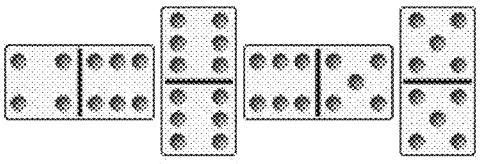
FIG. 3 shows a start position for the addition of tiles at a beginning of a game of dominoes.

FIG. 3 shows a start position for the addition of tiles at a first tile positioned at a beginning of a game of dominoes.

EXAMPLES OF GAME PLAY

Two types of domino player-versus-player competitive games is provided below.

First Example

Game play is structurally similar to Big 6 or Hi Five Dominoes Rules, without the critical reversing direction addition. Players connect dominoes, scoring points in multiples of fives. When players score, they win the exact amount of points (value in tokens, chips, money or credits) from the previous player in the player rotation starting from left to right, alternating each round. When players have no chips left, they are eliminated. Players have 15 seconds per play and this time limit is strictly enforced by the dealer. Players are given one warning of Slow Play per game. On the second Slow Play, violation players are eliminated from the game and forfeit all monies to the house. Multiple rounds of dominoes are played until there is a winner or no time left. Players have 1 hour to complete each game. If a winner hasn't been determined in the 1 Hour time period the player with the most points wins the game and all the monies. If players have the same amount of monies at the end of the 1 hour time period, players will continue play and go into a sudden death overtime. The first player that scores wins.

Buy In—Each player has the same amount of money to start the game. $200.00 Dollars is an example of the Buy In. Each player gets 80 chips totaling the $200, such as 30-$5.00 Dollar Chips=$150.00 that represents 150 points and 50-$1.00 dollar chips=$50.00 Reserved for pulling and passing.

Fees that are $1.00 each and are converted into this lower denomination for that purpose. These fees can also be won by opposing players after losing all their $5.00 dollar/point chips (for paying off players scoring multiples of five points). There are No Re-Buys.

Play Rotation—Rotation Arrow

A Play Rotation arrow is displayed, for example, on a digital screen that determines the direction of play, alternating each round starting from left to right.

House Shuffle—The dealer shuffles every hand and following the House Shuffle, each player pulls 5 domino tiles each. The dealer places the remaining dominoes in the Boneyard.

Play of the underlying game proceeds with sequential players placing tiles on the base or starting (highest double tile, generally) tile. Subsequent tiles are placed matching numbers-to-numbers in a row. Players must place tile on their turns. If no tile is available in their hand, they must pay $1 (1 unit) to the house for each tile placed, or pay a unit multiple to pass. The gaming event ends when no player can place tiles and the boneyard is empty, one players has placed all his/her tiles, one player has lost an entire buy-in, and the like. A player with no tiles is paid according to the total number of pips on all remaining players' tiles.

Examples of Side Bets—($5.00 Minimum Bet—$40 Maximum Bet) All Side Bets are required to be wagered on before the House Shuffle. Side Bets are at the beginning of the game only, the higher the side bet the quicker the game and the player that wins the side bet will have a greater advantage on other players to win the game because they will have more points and the beginning of the game.

1. Big 6:—The player that pulls the Big 6 Domino or Highest Double Domino.
2. First To Score—The first player to score points wins the side bet, with odds dependent on the number of players.
3. Domino—The player that plays all of there tiles first.

Promotional Spinning Wheel—(5 Doubles) If a player gets 5 doubles when they Draw their dominoes from the Boneyard the player gets to spin the Promotional Spinning Wheel for a guaranteed chance to win Cash or Prizes depending on the promotion.

A Dealer shuffles the dominoes, either in a mechanical tile shuffler or by spreading the tiles on a surface and mixing them randomly face down.

Each player will draw 5 dominoes each to form initial playing hands of domino tiles.

The player with the highest double domino in his/her initial plying hand will start the game Or, if there are no doubles, some other determinant, such as the highest domino tile pip count).

As players score (e.g., ordinarily in units of five points), their opponent will give them the exact point amount they score in money/chips.

The first player with no money left loses the game. For every time players pull or pass the players pay the house a $1.00 fee. Players must pull tiles from the boneyard when they are incapable of playing a tile on the dominoes in active play on the game surface. Players must continue to draw until they can lay down a tile or until the boneyard is exhausted, which may end the game.

Players will play multiple rounds until they've won all their opponents' points, chips or money. Play of each game will end when any player places all of his domino tiles from his/her hand.

After a player's hand is empty, all other players count the pips on their remaining tiles and pay the winning player according to that number of pips (often rounding up or down to units of five).

Another example can be:

1. At least 2Players begin with a standard $200 Buy In.
2. The House will take a 10% Rake.
3. Player will begin the game with $w180 dollars each.
4. Players 1 & 2 Place $10 dollar Side Bets on the 3 Side Bets.
   a. Highest Double Domino—$10 each
   b. First To Score—$10 each
   c. Domino (First player to play all their tiles)—$10 each
5. The dealer will shuffle the tiles and or cards.
6. Players will draw 5 dominoes each.
7. Player 1 starts the game with a 5-5 domino.
8. Player 2 will pay Player 1 $10
9. Player 1 will collect his $10 dollar bet for the First to Score and $10 dollars for the Highest Double Domino
10. Player 1 will have $210 dollars in cash and Player 2 will have $150 dollars
11. Player 2 plays a 5-0 domino and scores 10 points
12. Player 1 will pay Player 2 $10 dollars
13. Player 1 can't play and Pull 3 dominoes. Player 1 pays $3.00 to the House $1.00 for every domino
14. Player 1 plays a 1-0 domino and he/she doesn't score.
15. Player 2 plays a 5-4 and score 5 points.
16. Player 1 pays Player 2-$5.00
17. Player 1 plays a 6-1 and scores 10 points.
18. Player 2 pays Player 1 $10 dollars The claims are intended to represent generic concepts and are not intended to be limited by any specific example.

The invention claimed is:

1. A system for playing a competitive wagering domino event comprising a play surface having positions for from 2-8 players, 28 standard domino tiles on the play surface and a play rotation sign that is reversible to indicate direction of play in player order for each game executed on the play surface.

2. The system of claim 1 wherein the play surface comprises a game play felt-texture surface and the play rotation sign is a physical element with a single directional arrow on a face of the physical element that lays on the play surface.

3. The system of claim 1 wherein the play surface comprises a game play felt-texture surface and the sign is an electronic display element visible to all player positions at the play surface, the electronic display element with a single directional arrow on a face of the electronic display element that points in a single direction of play progression for a single round of the competitive wagering domino game.

4. The system of claim 3 wherein the play rotation sign is on a post adjacent to or on the game play felt-texture surface.

5. The system of claim 3 wherein each round of play of the competitive wagering domino games is identified by sequences of odd and even numbers indicating which direction the directional arrow is to point.

6. The system of claim 4 wherein each round of play of the competitive wagering domino games is identified by sequences of odd and even numbers indicating which direction the directional arrow is to point.

7. The system of claim 2 wherein the physical element has arrows on both sides of the physical element, and at least one different symbol on each side indicating which way the arrow is to face.

8. The system of claim 3 wherein there is a button to be used by a single player position or a dealer position during a round of play of the competitive wagering domino game to change the direction of play after the completion of the round of play.

9. The system of claim 3 wherein the electronic display element indicates individual ones of player positions on the game play felt-texture surface where a first player is located and a single direction of movement indicated by the directional arrow.

10. The system of claim 3 wherein after completion of a round of play of the competitive domino wagering game, the indication of the individual one of the player position moves in a direction to a different player position and the directional arrow reverses its direction.

11. A method for executing a competitive domino wagering event comprising players identifying a specific value for each pip on a tile, a first domino is placed on a game table surface, an identified first player at the game table places a tile from a hand of tiles from the first player to form a first tile game play set;

the method being executed on a system for playing a competitive wagering domino event comprising a game table play surface having positions for from 2-8 players, 28 standard domino tiles and a play rotation sign that is reversible to indicate direction of play in player order for each game executed on the play surface;

a player adjacent the first player along the indicated direction of the play rotation sign then places a tile on the first tile game play set to create a second tile game play set;

all players at the play surface consecutively along the indicated direction of the play rotation sign playing one tile at a time into progressive tile game play sets until a player has exhausted all tiles in that player's hand of tiles, ending a round of play; and after the ended round of play, the play rotation sign is changed to reverse the direction of play.

12. The method of claim 11 wherein the game table play surface comprises a game play felt-texture surface and the play rotation sign is a physical element with a single directional arrow on a face of the physical element that lays on the play surface and the rotation sign is manually reversed after the ended round of play.

13. The method of claim 11 wherein the play surface comprises a game play felt-texture surface and the sign is an electronic display element visible to all player positions at the play surface, the electronic display element with a single directional arrow on a face of the electronic display element that points in a single direction of play progression for a single round of the competitive wagering domino game, and after the ended round of play, the directional arrow on the electronic display element reverses.

14. The method of claim 13 wherein the play rotation sign is on a post adjacent to or on the game play felt-texture surface.

15. The method of claim 13 wherein each round of play of the competitive wagering domino games is identified by sequences of odd and even numbers indicating which direction the directional arrow is to point.

16. The method of claim 14 wherein each round of play of the competitive wagering domino games is identified by sequences of odd and even numbers indicating which direction the directional arrow is to point.

17. The method of claim 12 wherein the physical element has arrows on both sides of the physical element, and at least one different symbol on each side indicating which way the arrow is to face.

18. The method of claim 13 wherein there is a button to be used by a single player position or a dealer position during a round of play of the competitive wagering domino game to change the direction of play after the completion of the round of play, and the single player or dealer activates the button.

19. The method of claim 13 wherein the electronic display element indicates individual ones of player positions on the game play felt-texture surface where a first player is located and a single direction of movement indicated by the directional arrow, and the directional arrow on the electronic display element reverses after the completion of the round of play.

20. The method of claim 13 wherein after completion of a round of play of the competitive domino wagering game, the indication of the individual one of the player position moves in a direction to a different player position and the directional arrow reverses its direction after the completion of the round of play.

* * * * *